US005342204A

United States Patent [19]

Och

[11] Patent Number: 5,342,204

[45] Date of Patent: Aug. 30, 1994

[54] LOW VOLTAGE BUSBAR LIGHTING APPARATUS

[75] Inventor: Mathias Och, Erlen, Switzerland

[73] Assignee: Herma AG, Zug, Switzerland

[21] Appl. No.: 82,241

[22] Filed: Jun. 24, 1993

Related U.S. Application Data

[63] Continuation of Ser. No. 499,373, Jul. 18, 1990, abandoned.

[30] Foreign Application Priority Data

Sep. 19, 1988 [CH] Switzerland ..... 3489/88
Aug. 24, 1989 [WO] PCT Int'l Appl. ..... PCT/CH89/00152

[51] Int. Cl.[5] ..... H01R 25/14

[52] U.S. Cl. ..... 439/39; 439/110; 439/936; 174/117 A

[58] Field of Search ..... 174/117 A; 439/39, 40, 439/110–112, 527, 936, 113–115, 119–121; 362/239, 398, 250

[56] References Cited

U.S. PATENT DOCUMENTS

| | | | |
|---|---|---|---|
| 2,749,382 | 6/1956 | Lockard | 174/117 A |
| 3,524,921 | 8/1970 | Wolf | 174/117 A |
| 4,045,750 | 8/1977 | Marshall | 174/117 A |
| 4,107,767 | 8/1978 | Anquetin | 362/249 |
| 4,173,035 | 10/1979 | Hoyt | 362/249 |
| 4,486,649 | 12/1984 | Lane, Jr. | 174/117 A |
| 4,690,474 | 9/1987 | Smart et al. | 439/120 |
| 4,752,756 | 6/1988 | Bartel | 335/207 |
| 5,027,262 | 6/1991 | Freed | 439/115 |

FOREIGN PATENT DOCUMENTS

| | | | |
|---|---|---|---|
| 286198 | 1/1966 | Australia | 439/39 |
| 238017 | 9/1987 | European Pat. Off. . | |
| 1282126 | 11/1968 | Fed. Rep. of Germany . | |
| 3407518 | 9/1985 | Fed. Rep. of Germany . | |
| 2606941 | 5/1988 | France . | |
| 1466160 | 3/1977 | United Kingdom | 439/113 |
| 2233837 | 1/1991 | United Kingdom | 439/39 |

*Primary Examiner*—Gary F. Paumen
*Attorney, Agent, or Firm*—Johnson & Gibbs

[57] ABSTRACT

A low voltage busbar lighting apparatus which can be easily and cheaply mounted on a building structure and which is suitable for a wide variety of interior lighting applications. The lighting apparatus includes a busbar, a lamp stand or base which is mounted on the busbar and a current supply which is also mounted on the busbar. The busbar includes an adhesive film base and at least one longitudinal steel strip. The lamp base and the current supply are similarly constructed and each includes a base plate and at least one permanent magnet secured to the under side of the base plate.

3 Claims, 4 Drawing Sheets

LOW VOLTAGE BUSBAR LIGHTING APPARATUS

This application is a continuation of application number 07/499,373, filed Jul. 8, 1990, abandoned.

BACKGROUND OF THE INVENTION

1. Field of the Invention

The present invention relates to a lighting apparatus which operates at low voltages. More particularly, this invention relates to a low voltage busbar lighting apparatus.

2. Description of Related Art

Lighting apparatuses utilizing busbars are well-known in the art. If busbar lighting apparatuses are to be operated with a standard power supply, e.g., 110 volts or 220 volts, a variety of rules and precautions for handling hazardous voltages must be observed during the installation and maintenance of such busbar lighting apparatuses. Accordingly, rigid busbars having covered and protected guides for the leads which carry the electrical current are used. Furthermore, the sliding contacts used for connecting the light fixtures to the busbars are specially shaped for added protection.

Installation of conventional busbar lighting apparatuses is generally performed by a licensed technician so that all safety considerations are taken into account. Consequently, significant costs are associated with professional installation. Furthermore, because of these safety considerations, the busbar cross-section is typically a U-shape or a C-shape. Such busbars require the use of a special covered guide for the current leads and further require that the sliding contact connected to the lamp socket be inserted directly into the busbars.

On the other hand, low voltage lighting apparatus, i.e. those designed to operate in the range of 6 to 24 volts, are also well-known in the art. Such apparatuses essentially comprise a pair of electrical wires running through the space being lighted. While these apparatuses offer a simple and cost effective solution to the problem of interior lighting, they do not permit a wide variety of options when it comes to decor and interior lighting design.

It is an object of the present invention to provide a low voltage busbar lighting apparatus which can be mounted easily and without the need for professional assistance.

It is another object of this invention to provide a low voltage busbar lighting apparatus which is suitable for self-mounting.

It is yet another object of this invention to provide a low voltage busbar lighting apparatus which can be manufactured at minimum cost.

It is still yet another object of this invention to provide a low voltage busbar lighting apparatus which affords great flexibility in interior lighting design.

Yet another object of this invention is to provide a low voltage busbar lighting apparatus which satisfies aesthetic requirements in interior decorating.

SUMMARY OF THE INVENTION

A low voltage busbar lighting apparatus includes a busbar, a lamp base and a current supply. The busbar has an adhesive film base by which the busbar may be easily attached to a building structure. The lamp base and the current supply are similarly constructed and mounted directly to the surface of the busbar.

In one aspect of the present invention, the busbar includes an insulating support positioned between the adhesive film base and a pair of steel strips used for conducting electricity. The steel strips may be bonded directly to the surface of the insulating support or may be held in position within grooves or protective edges. The lamp base or current supply associated with this aspect of the invention includes a pair of permanent magnets secured to a base plate and means for connecting the magnets to a lighting fixture or a power supply, respectively. Electrical contact and magnetic coupling is established by mounting the magnets of the lamp base or current supply to the steel strips of the busbar. Proper mounting may be facilitated by providing a central ridge in the insulating support which fits between the magnets and underneath the base plate. Alternatively, a central block may be secured to the base plate which fits within a central cavity in the insulating support.

In a further aspect of the invention, the steel strips of the busbar are bonded directly to the adhesive film base but are separated from each other by a central longitudinal ridge. Such a construction of the busbar affords a particularly flat configuration. The embodiments of the lamp base or current supply associated with this aspect of the invention are similar to those described above.

In yet another aspect of the invention, a single steel strip is attached to the adhesive film and extends across the entire width of the busbar. A pair of narrow conductive strips are positioned along the upper surface of the steel strip and may be coated with insulating material. The lamp base or current supply associated with this aspect of the invention includes a single permanent magnet secured to a base plate and a pair of contact springs secured to the base plate, one on each side of the magnet. An insulating strip may be interposed between the conducting strips of the busbar. Electrical contact is established by mounting the contact springs of the lamp base or current supply onto the conductive strips of the busbar. The lamp base or current supply are held in position by the magnetic coupling between the magnet and the steel strip of the busbar.

In still yet another aspect of the present invention, the busbar includes a pair of steel strips each of which is partially coated within insulating material and partially left exposed or electroplated. In one embodiment of the busbar associated with this aspect of the invention, the partially coated steel strips are directly bonded to the adhesive film base. In an alternative embodiment of the busbar, the partially coated steel strips are separated by a central strip and mounted on an insulating support attached to the adhesive film base. The lamp base or current supply embodiments associated with this aspect of the invention include the contact spring pair discussed above. Electrical contact is established by mounting the contact springs on the exposed or electroplated portions of the partially coated steel strips.

BRIEF DESCRIPTION OF THE DRAWINGS

The present invention may be better understood and its numerous objects and advantages will become more apparent to those skilled in the art by reference to the attached drawings where.

DETAILED DESCRIPTION OF THE INVENTION

Figure 1:
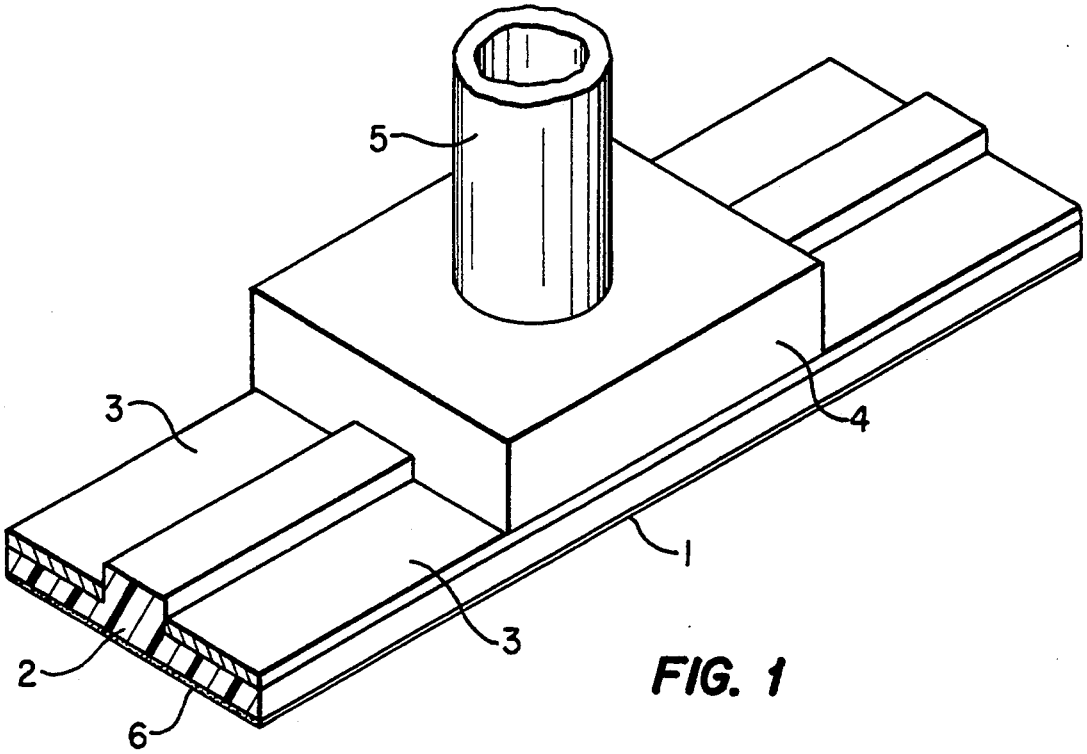
FIG. 1 is a perspective view of a low voltage busbar lighting apparatus constructed in accordance with the teachings of the present invention.

Referring to the drawings in detail wherein like numerals designate like parts and referring first to FIG. 1*a*, a perspective view of a low voltage busbar lighting apparatus constructed in accordance with the teachings of the present invention may now be seen. The low voltage busbar lighting apparatus includes a busbar 1 and a lamp stand or base 4 mounted on the busbar 1. The busbar 1 comprises an insulating support 2 and first and second strip tracks 3. A post 5 is secured to the lamp base 4. A light fixture (not shown) is connected to the post 5. Along the base of the insulating support 2, an adhesive film 6 is formed thereon. The adhesive film 6 allows the busbar 1 to be mounted either directly on building framework such as ceilings, walls and beams, or on special mounting rails.

Figure 2:
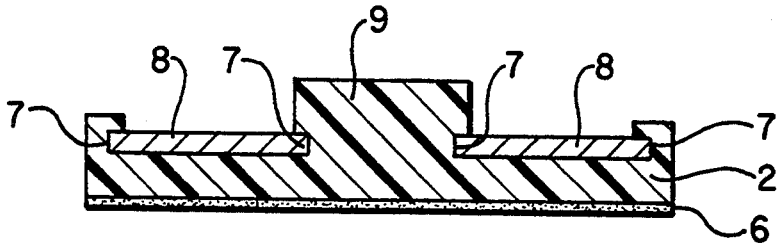
FIG. 2 is a cross-sectional view of an alternative embodiment of the busbar shown in FIG. 1.

Referring next to FIG. 2, a cross-sectional view of an alternative embodiment of the busbar shown in FIG. 1 may now be seen. In this embodiment, the insulating support 2, which is fabricated from an elastomer, has a rectangular ridge 9 and four grooves 7 along the upper surface thereof. The ridge 9 is formed along the central longitudinal axis of the insulating support 2 and divides the four grooves 7 into first and second groove pairs. First and second steel strips 8 are inserted within the first and second groove pairs, respectively, such that the upper sides of the steel strips 8 are exposed outside the grooves 7. The steel strips 8 serve both as current conductors and also as anchors for permanent magnets (not shown) located inside the lamp base 4. The ridge 9 insulates the steel strips 8 from contact with other metal objects, thereby preventing a short circuit. The ridge 9 also prevents the magnets 10 from being mounted incorrectly or crosswise on the steel strips 8, thereby preventing the magnets 8 from causing a short circuit. The ridge 9 also facilitates the guiding or positioning of the lamp base 4. The base of insulating support 2 is provided with an adhesive film 6 which serves the same function as described in connection with FIG. 1.

Figure 3:
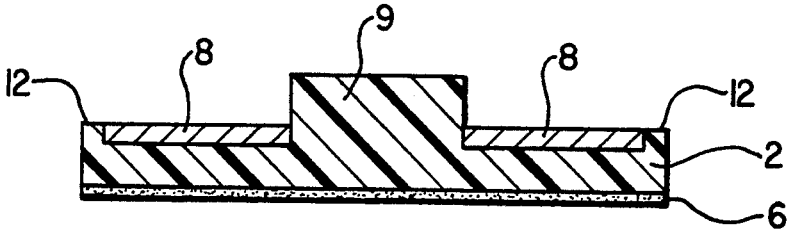
FIG. 3 is a cross-sectional view of a third embodiment of the busbar shown in FIG. 1.

Referring next to FIG. 3, a cross-sectional view of a third embodiment of a busbar shown in FIG. 1 may now be seen. In this embodiment, first and second steel strips 8 are bonded to the surface of the insulating support 2. Hence, while the steel strips 8 of FIG. 2 are held in position by the grooves 7, the steel strips 8 of FIG. 3 are held in place by adhesion. A protective edge 12 is formed on each side of the steel strips 8 and along the upper edge of insulating support 2.

Figure 4:
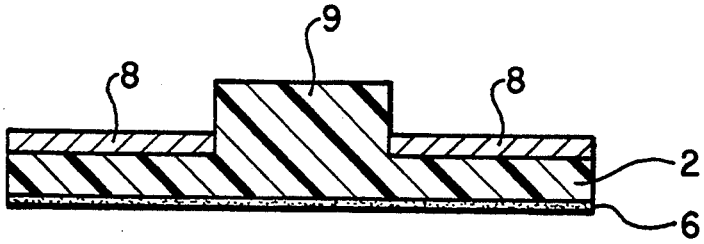
FIG. 4 is a cross-sectional view of the busbar shown in FIG. 1.

Referring next to FIG. 4, a cross-sectional view of the busbar shown in FIG. 1 may now be seen. The embodiment shown in FIG. 4 is substantially similar to that shown in FIG. 3. Here, however, first and second steel strips 8 extend out to the edges of the insulating support 2 on either side of the ridge 9, respectively. As in FIG. 3, the steel strips 8 are bonded to the upper surface of the insulating support 2.

Figure 5:
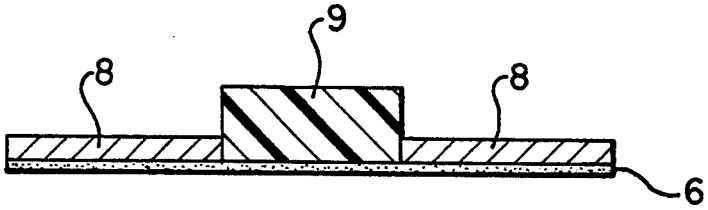
FIG. 5 is a cross-sectional view of the fourth embodiment of the busbar shown in FIG. 1.

Referring next to FIG. 5, a cross-sectional view of a fourth embodiment of the busbar shown in FIG. 1 may now be seen. In this embodiment, the ridge 9 is formed along the central longitudinal axis of the busbar 1. The ridge 9 is made, for example, from an elastomeric plastic. The adhesive film 6 is provided along the base of the busbar 1. First and second steel strips 8 are bonded directly to the adhesive film 6 on either side of the ridge 9, respectively. Note that, in this embodiment, the absence of the insulating support 2 in the busbar 1 affords a particularly flat configuration.

Figure 6:
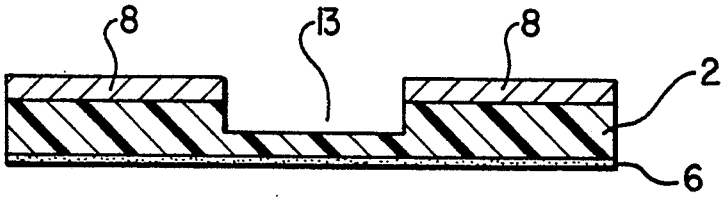
FIG. 6 is a cross-sectional view of a fifth embodiment of the busbar shown in FIG. 1.

Referring next to FIG. 6, a cross-sectional view of a fifth embodiment of the busbar shown in FIG. 1 may now be seen. This embodiment is generally similar to that illustrated in FIG. 4. Here, however, the insulating support 2 has a cavity 13 in place of the ridge 9 of FIG. 4.

The various embodiments of the busbar 1 shown in FIGS. 2–6, have at least one element in common —the two steel strips 8. In an alternative embodiment of each of the embodiments illustrated in FIGS. 2–6, a flat steel gauze, preferably constructed from fine wires which conduct electricity, is substituted for each of the two steel strips 8. Instead of bonding the gauze to the insulating support 2, the gauze may be meshed with the insulating support 2 in the form of a strip.

Figure 7:
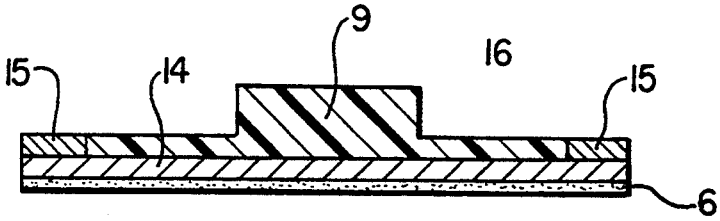
FIG. 7 is a cross-sectional view of a sixth embodiment of the busbar shown in FIG. 1.

Referring next to FIG. 7, a cross-sectional view of a sixth embodiment of the busbar shown in FIG. 1 may now be seen. In this embodiment, a single steel strip 14 extends across the entire width of the busbar 1. The steel strip 14 is bonded to the adhesive film 6 formed along the base of the busbar 1. A coat of insulating material (not shown) covers the upper surface of the steel strip 14. First and second thin and narrow strips 15 are positioned along the upper surface of the steel strip 14 such that the strips 15 adhere flush with the edges of the steel strips 14. The strips 15 are made from a material having good conductivity, such as copper or the like. An insulating strip 16, fabricated from an elastomer, is interposed between the strips 15. The sides of the insulating strips 16 are flush with the sides of the strips 15 in the areas where they meet. The insulating strip 16 is analogous to the insulating support 2 of FIGS. 2–4. It may thus be seen that the functions of electrical by separate elements in the embodiment according to FIG. 7.

Figure 8:
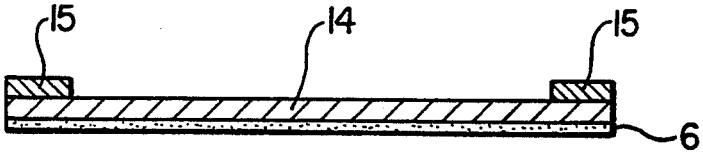
FIG. 8 is a cross-sectional view of a seventh embodiment of the busbar shown in FIG. 1.

Referring next to FIG. 8, a cross-sectional view of a seventh embodiment of the busbar shown in FIG. 1 may now be seen. The present embodiment is identical to that illustrated in FIG. 7 except that the insulating strip 16 of FIG. 7 is missing from the embodiment illustrated in FIG. 8.

Figure 9:
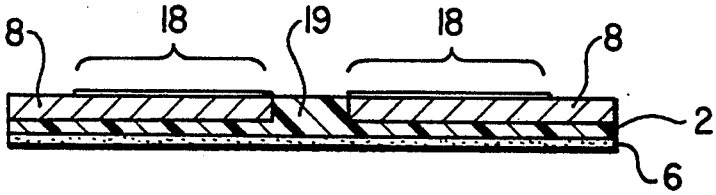
FIG. 9 is a cross-sectional view of an eighth embodiment of the busbar shown in FIG. 1.

Referring next to FIG. 9, a cross-sectional view of an eighth embodiment of the busbar shown in FIG. 1 may now be seen. In this embodiment, the busbar 1 comprises first and second steel strips 8, which, as in the case of FIGS. 2–6, are used both for current conduction and magnetic bonding. The steel strips 8 are mounted on the insulating support 2. As before, the insulating support 2 is formed of a material having elastomeric properties. A central strip 19 separates and insulates the first and second steel strips 8 from each other. Each of the surface areas of the steel strips 8 is coated over a width 18 while the remaining surface portions are either left exposed or electroplated, e.g., nickel-plated. As before, the adhesive film 6 is provided along the base of the insulating support 2.

Figure 10:
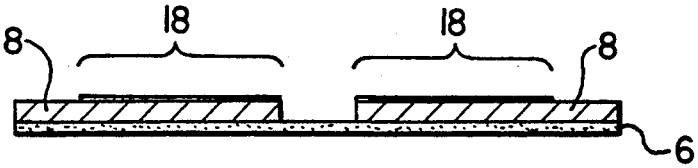
FIG. 10 is a cross-sectional view of a ninth embodiment of the busbar shown in FIG. 1.

Referring next to FIG. 10, a cross-sectional view of a ninth embodiment of the busbar shown in FIG. 1 may now be seen. The present embodiment is identical to that illustrated in FIG. 10 except that the insulating support 2 and the plastic strip 19 of FIG. 9 are missing from the embodiment illustrated in FIG. 10. In this embodiment of the present invention, the first and second steel strips 8, constructed similarly to those depicted in FIG. 9, are bonded directly to the adhesive film 6.

It may be easily seen that the various embodiments of the busbar 1 illustrated in FIGS. 2–9 are generally flat and flexible such that each embodiment of the busbar 1 can be rolled up easily at any time before mounting. In this manner, it is possible for the user to cut off a desired length of busbar from a busbar roll and to mount the desired piece of busbar on any given part of a building simply by means of the adhesive film 6. Moreover, this flat design makes it possible to attach the busbar of the present invention directly onto beams or other projections. In operation, the current carrying strips are connected to a transformer and the appropriate lamps are secured to the lamp bases. The low voltage busbar lighting apparatus is then ready for use.

Figure 11A:
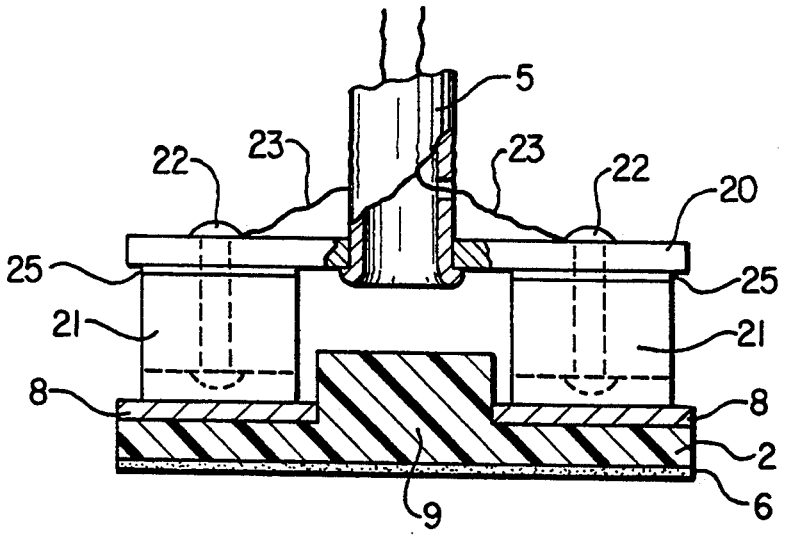
FIG. 11*a* is a side view of the lamp base shown in FIG. 1.
Figure 11B:
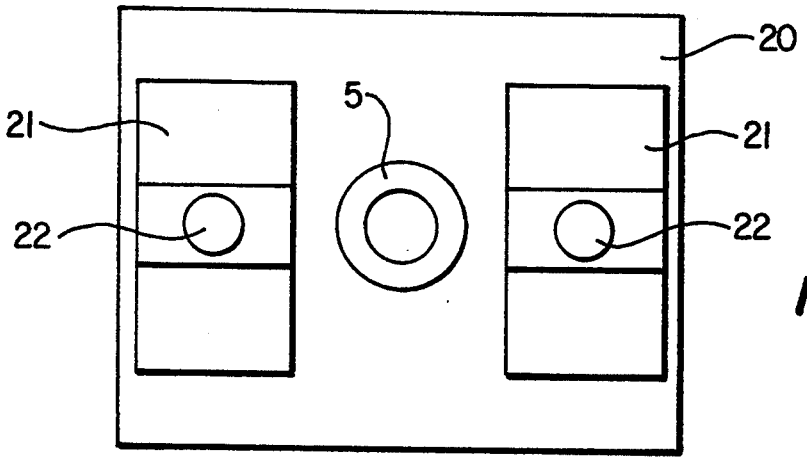
FIG. 11*b* is a bottom view of the lamp base of FIG. 11*a;*

Referring next to FIGS. 11*a* and 11*b*, the lamp base 4 shown in FIG. 1 may now be seen in more detail. In FIG. 11*a* the cover of the lamp base 4 shown in FIG. 1 has been removed and the lamp base may be seen in side view in the direction of the busbar 1. FIG. 11*a* shows an embodiment of the busbar 1 according to FIG. 4. FIG. 11*b* is a bottom view of the lamp base shown in FIG. 11*a*. The lamp base 4 comprises a base plate 20 and first and second permanent magnets 21. The upper sides of the magnets 21 are coupled to the base plate 20 while the lower sides of the magnets 21 rest on top of the busbar 1. Each of the first and second magnets 21 is secured to the base plate 20 by first and second rivets 22, respectively. The first and second magnets 21 rest on first and second steel strips 8, respectively. First and second thin elastomeric plates 25 are inserted between each of the first and second magnets 21, respectively, and the base plate 20. The plates 25 serve to minimize the effect of any dissimilarities between the magnets 21 and any unevenness in the base plate 20 or the steel strips 8. First and second wires 23 run downward through the post 5 and connect with the first and second rivets 22, respectively, at the surface of the base plate 20. The heads of the rivets 22 may be designed as cable terminals and the wires 23 may be clamped or soldered thereon. The post 5 may be secured to the base plate 20 either by a screw or by welding. The lamp base 4 is held to the busbar 1 by magnetic attraction between the magnets 21 and the steel strips 8. By appropriate selection of the magnets 21, the size of the magnetic force developed by the interaction between the magnets 21 and the steel strips 8 can be varied so that a lamp attached to the lamp base 4 may be supported in any desired position. Proper mounting of the lamp base 4 on the busbar 1 is facilitated by the presence of ridge 9 along the central longitudinal axis of busbar 1.

Figure 12:
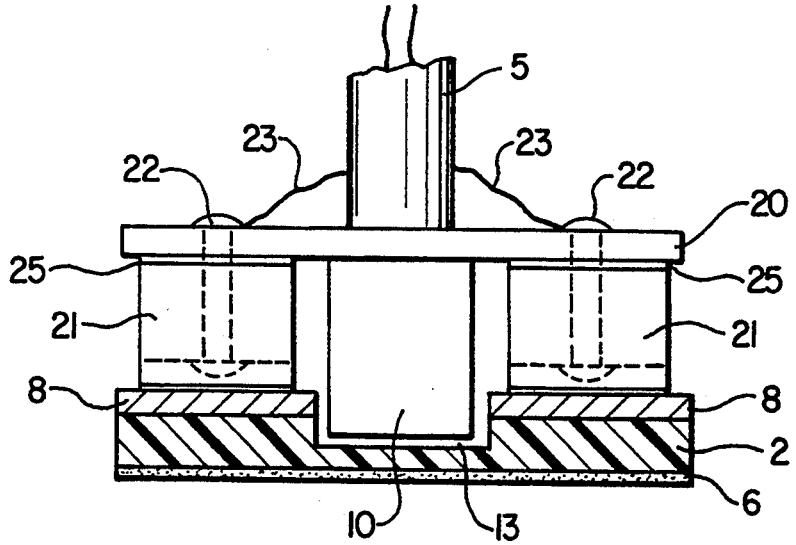
FIG. 12 is a side view of a second embodiment of the lamp base shown in FIG. 1.

Referring next to FIG. 12, a side view of a second embodiment of the lamp base shown in FIG. 1 may now be seen. While the embodiment of the lamp base shown in FIG. 11 is suitable for use with the embodiments of the busbar 1 shown in FIGS. 2–5, the present embodiment of the lamp base 4 is designed for use with the embodiment of the busbar 1 shown in FIG. 6. Here, a central plastic block 10 is secured to the underside of the base plate 20. The block 10 rests within the cavity 13 formed in the busbar 1 according to the embodiment shown in FIG. 6. Alignment of the block 10 across the cavity 13 ensures exact mounting of the lamp base 4 on the busbar 1. In this aspect, the cavity 13 in FIG. 12 serves the same purpose as ridge 9 in FIG. 11*a*.

Figure 13A:
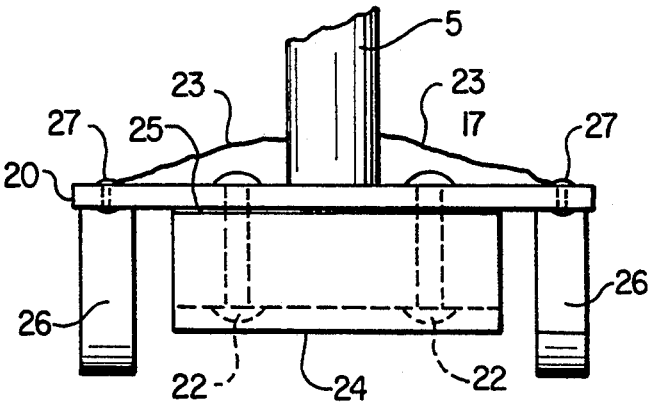
FIG. 13*a* is a first side view of a third embodiment of the lamp base shown in FIG. 1, as seen in the direction of the busbar shown in FIG. 1.
Figure 13B:
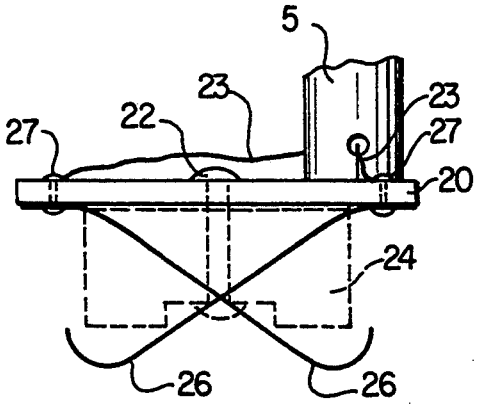
FIG. 13*b* is a second side view of the lamp base of FIG. 13*a*, as seen perpendicularly from the busbar shown in FIG. 1.
Figure 13C:
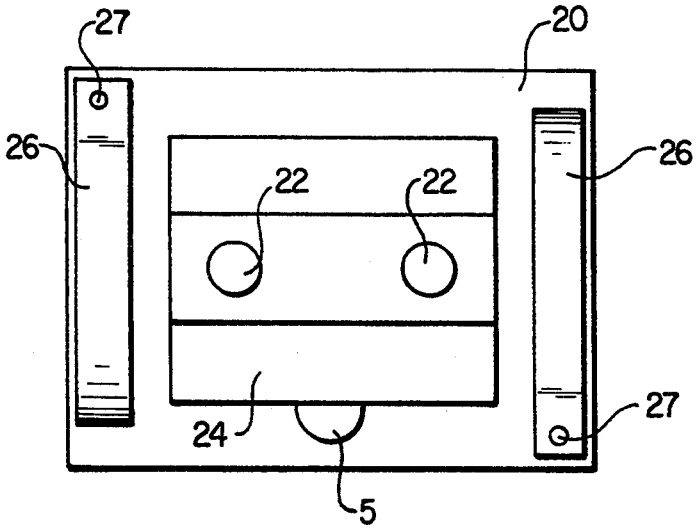
FIG. 13*c* is a bottom view of the lamp base of FIGS. 13*a–b*.

Referring next to FIGS. 13*a*, 13*b* and 13*c*, a third embodiment of the lamp base shown in FIG. 1 may now be seen. FIG. 13*a* shows a side view of the lamp base 4 in the direction of the busbar 1. FIG. 13*b* shows another side view of the lamp base 4 perpendicularly from the busbar 1. FIG. 13*c* is a bottom view of FIGS. 13*a–b*. The present embodiment of the lamp base 4 is designed to be used with the embodiments of the busbar 1 shown in FIGS. 7–10. According to FIGS. 13*a–c*, the lamp base 4 comprises a base plate 20, a single permanent magnet 24 and a first and a second contact springs 26. Unlike the magnets 21 of FIGS. 11–12, the magnet 24 does not conduct electricity but serves only to mount the lamp base 4 to the steel strips 14 of FIGS. 7–8 or the steel strips 8 of FIGS. 9–10. The contact springs 26 rest on the strips 15 of FIGS. 7–8 or on the exposed portions of the steel strips 8 of FIGS. 9–10. Note that if the embodiment of the busbar 1 shown in FIG. 7 is used with the present embodiment of the lamp base 4, an opening (not shown) is provided along the central longitudinal axis of the magnet 24 in order to accommodate the ridge 9 of FIG. 7.

In FIG. 13*a*, the magnet 24 is secured to the base 20 by means of rivets 22. An elastomeric plate 25 separates the upper surface of the magnet 24 from the lower surface of the base plate 20. Each of the first and second contact springs 26 is secured to the base plate 20 by a corresponding rivet 27. The two rivets 27 are positioned diagonally opposite each other so that the compression forces of the contact springs 26 are equalized with respect to the magnetic bond formed between the lamp base 4 and the busbar 1. Each of the first and second wires 23 which originates in the lamp post 5 is connected with a corresponding one of the first and second rivets 27 along the upper surface of the base plate 20. As before, the wires 23 may be clamped or soldered to the rivets 27. In FIGS. 13*b–c*, the post 5 may be seen attached to the lamp base 4 at the edge of the base plate 20.

An alternative embodiment of each of the embodiments of the lamp base 4 shown FIGS. 11–13 includes a base plate fabricated from metal and two sockets made of insulating material. The insulating sockets surround the rivets 22 or 27, thereby insulating the magnets 21 or the contact springs 26 from the metal base plate.

The configurations of the lamp base depicted in FIGS. 11–13, as described above, may also be used in supplying electricity to the busbar 1. In such instance, the particular configuration acts as a current supply rather than an output terminal. The lamp post 5 may be oriented in any appropriate direction by suitable design of the base plate 20. Note that while the lamp base 4 is shown in FIG. 11 with the cover removed, the cover itself has no technical function but is there only for aesthetic purposes.

The foregoing description shows only certain particular embodiments of the present invention. However, those skilled in the art will recognize that many modifications and variations may be made without departing substantially from the spirit and scope of the present invention. Accordingly, it should be clearly understood that the form of the invention described herein is exemplary only and is not intended as a limitation on the scope of the invention.

I claim:

1. A low voltage busbar lighting apparatus comprising:

a busbar, said busbar including an insulative support, an adhesive film formed along the base of said insulative support, a first and a second longitudinal steel strip being mounted one across from the other on the top surface of said insulative support, and said insulative support having a central longitudinal cavity interposed between said first and second steel strips;

a lamp base for mounting on said busbar, said lamp base including a base plate, a first permanent magnet secured to said base plate for engagement with said first steel strip of said busbar, a second permanent magnet secured to said base plate for engagement with said second steel strip of said busbar, a means for electrically connecting a lamp to said first and second steel strips of said busbar, and a central block secured to said base plate between said first and second permanent magnets and adapted to fit within the central longitudinal cavity of said insulative support of said busbar;

wherein said busbar attaches to a building structure by said adhesive film; and wherein said lamp base is secured to said busbar by the magnetic force developed between said first and second permanent magnets and said first and second steel strips.

2. A busbar for a low voltage lighting apparatus comprising:

an insulating support having a central longitudinal cavity in a top surface thereof:

an adhesive film formed along a base of said insulating support;

a first and a second steel strip mounted one across from the other on the top surface of said insulative support, the central longitudinal cavity of said insulative support being interposed between said first and second steel strips;

wherein said busbar attaches to a building structure by said adhesive film; and wherein said low voltage lighting apparatus electrically connects to said first and second steel strips by a first magnet and a second magnet.

3. A low voltage busbar according to claim 2 wherein said first and second steel strips are bonded to the surface of said insulating support.

* * * * *

UNITED STATES PATENT AND TRADEMARK OFFICE

CERTIFICATE OF CORRECTION

PATENT NO. : 5,342,204

DATED : August 30, 1994

INVENTOR(S) : Mathias Och

It is certified that error appears in the above-indentified patent and that said Letters Patent is hereby corrected as shown below:

Column 4, line 64: After "electrical", insert --contact and magnetic bonding are each performed--

Signed and Sealed this

Eighteenth Day of April, 1995

Bruce Lehman

*Attest:*

BRUCE LEHMAN

*Commissioner of Patents and Trademarks*

*Attesting Officer*